US005477832A

United States Patent [19]

Visser

[11] Patent Number: 5,477,832

[45] Date of Patent: Dec. 26, 1995

[54] ENGINE FUEL CONTROL SYSTEM WITH FUEL DISTILLATION POINT COMPENSATION

[75] Inventor: Kenneth A. Visser, Dearborn Heights, Mich.

[73] Assignee: Ford Motor Company, Dearborn, Mich.

[21] Appl. No.: 353,606

[22] Filed: Dec. 12, 1994

[51] Int. Cl.[6] ..... F02D 41/06

[52] U.S. Cl. ..... 123/491; 123/492; 123/493

[58] Field of Search ..... 123/179.16, 491, 123/492, 493

[56] References Cited

U.S. PATENT DOCUMENTS

| | | | |
|---|---|---|---|
| 4,357,923 | 11/1982 | Hideg | 123/492 |
| 4,454,847 | 6/1984 | Isomura et al. | 123/492 |
| 4,543,973 | 10/1985 | Ho | 137/1 |
| 4,706,630 | 11/1987 | Wineland et al. | 123/491 X |
| 4,922,877 | 5/1990 | Nagaishi | 123/478 |
| 5,170,763 | 12/1992 | Kitajima et al. | 123/491 |
| 5,179,925 | 1/1993 | Orminski | 123/491 |
| 5,186,149 | 2/1993 | Kitajima et al. | 123/491 |
| 5,301,648 | 4/1994 | Uchinami | 123/491 |
| 5,345,908 | 9/1994 | Nishimura et al. | 123/491 X |
| 5,353,768 | 10/1994 | Messih et al. | 123/491 |
| 5,419,296 | 5/1995 | Yamaura | 123/491 X |

*Primary Examiner*—Willis R. Wolfe
*Attorney, Agent, or Firm*—Allan J. Lippa; Roger L. May

[57] ABSTRACT

A control system and method to correct for variations in distillation point of different fuels inducted into an engine (40). Engine rotations or portions thereof are counted until engine start (100–110). A fuel type correction signal is generated from the count (200–212) which then corrects a fuel delivery signal (612–624).

16 Claims, 5 Drawing Sheets

ENGINE FUEL CONTROL SYSTEM WITH FUEL DISTILLATION POINT COMPENSATION

FIELD OF THE INVENTION

The field of the invention relates to methods and systems for controlling the delivery of fuel to an internal combustion engine. In a particular aspect of the invention, the field of the invention relates to correcting fuel delivery during cold engine operation for improved drivability.

BACKGROUND OF THE INVENTION

Engine air/fuel control systems are known which provide an open loop fuel delivery signal during cold engine operation. Such open loop fuel delivery signal is derived from a measurement of air mass inducted into the engine and a desired air/fuel ratio. After the engine warms, this open loop fuel delivery signal is trimmed by a feedback variable derived from an exhaust gas oxygen sensor to maintain engine operation at stoichiometry. It is also known to correct the open loop fuel delivery signal for delays in fuel delivery to an engine cylinder caused by condensation on the engine intake manifold and intake valve. Until the engine is sufficiently warmed, this condensation will exceed the corresponding evaporation thereby causing a delay in fuel delivery. Compensation to the fuel delivery for this delay is provided by a transient fuel correction value.

The inventor herein has recognized numerous problems with the above approaches. For example, the rate of fuel evaporation will vary with the fuel type. Accordingly, the above described transient fuel correction may not properly correct for transient fuel delay for all fuel types. Further, the open loop fuel delivery signal will not always provide the desired fuel during cold engine operation when different fuel types are used. These occurrences may result in rough cold engine operation.

SUMMARY OF THE INVENTION

It is an object of the invention herein to detect different fuel types having different distillation points and correct engine fuel delivery as a function of the different fuel type. The above object is achieved, and disadvantages of prior approaches overcome, by providing both a control system and method to correct for variations and distillation point of fuel inducted into an engine. In one particular aspect of the invention, the method comprises the steps of: delivering fuel to the engine in relation to a fuel delivery signal; counting engine rotations during engine cranking until engine start; generating a fuel type correction signal from the count related to the fuel distillation point; and correcting said fuel delivery signal with the fuel type correction signal.

Preferably, the above method further comprises the step of adding a transient fuel correction signal to the fuel delivery signal to compensate for fuel condensing on engine surfaces. And, preferably, the method further comprising a step of adding a second fuel type correction signal to the transient fuel correction signal, the second fuel type correction signal also being generated from the count.

An advantage of the above aspect of the invention is that variations in engine drivability are minimized when different fuel types having a different distillation point are utilized. A further advantage of the invention is that transient fuel correction during cold engine operation is corrected for different fuel types thereby minimizing any variations in drivability.

In another aspect of the invention, the system comprises: an intake manifold coupled to the engine having at least one intake valve for each cylinder coupled to the intake manifold; at least one fuel injector coupled to the intake manifold for injecting fuel into the intake valve; transient fuel correction means for providing a transient fuel correction to a fuel delivery signal driving the fuel injector, the transient fuel correction being related to a difference between fuel condensing and fuel evaporating from the intake manifold and the intake valve; and fuel type correction means for correcting the transient fuel correction with a fuel type correction related to fuel distillation point, the fuel type correction being generated from a count of engine rotations occurring during engine cranking until engine starts.

An advantage of the above aspect of the invention is that fuel delivery to the engine, including transient fuel corrections, are corrected for different fuels having different distillation points. Improved drivability during cold engine operation is thereby obtained.

DETAILED DESCRIPTION OF AN EMBODIMENT

Figure 1:
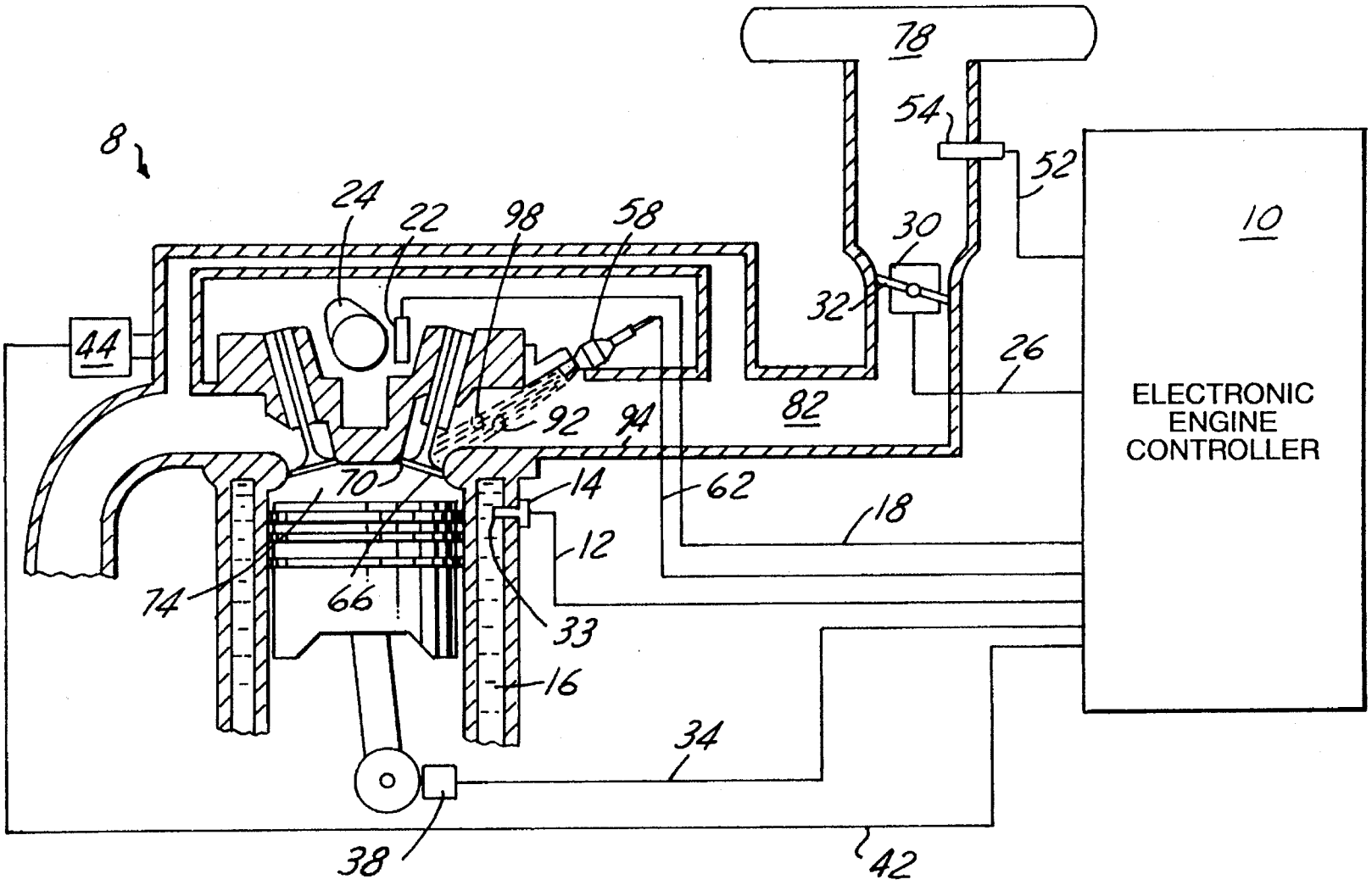
FIG. 1 is a schematic, partially cross-sectional illustration of an internal combustion engine and an electronic engine controller which embody the principles of the invention.

An internal combustion engine 8 comprising a plurality of cylinders, one cylinder of which is shown in FIG. 1, is controlled by electronic engine controller 10 (EEC). A plurality of signals from engine 8 are received by controller 10 including: an engine coolant temperature (ECT) signal 12 from an engine coolant temperature sensor 14 which is exposed to engine coolant circulating through coolant sleeve 16; a cylinder identification (CID) signal 18 from a CID sensor 22 coupled to camshaft 24; a throttle position signal 26 generated by a throttle position sensor 30 coupled to throttle 82; a profile ignition pickup (PIP) signal 34 generated by a Hall effect sensor 38; a heated exhaust gas oxygen (HEGO) signal 42 from a HEGO sensor 44; an air intake temperature signal 51 from an air temperature sensor 16; and an air flow signal 52 from an air flow meter 54.

Controller 10 processes the signals received from engine 8 and generates a fuel injector signal transmitted to fuel injector 58 on signal line 62 to control the amount of fuel delivered by fuel injector 58. The entry of an air/fuel mixture into combustion chamber 74 is controlled by intake valve 66 opening and closing against intake port 70.

Air drawn through air intake 78 passes into induction system 82 where it is mixed with fuel before induction into intake port 70. A portion of the fuel from fuel injector 58, seen at 92, directly impacts the walls 94 of induction system 82, the temperature of which is a function of engine coolant temperature ECT. Another portion of the fuel injected by injector 58, seen at 98, directly impacts intake valve 66, which is less affected by the temperature of the engine coolant than are walls 94 of induction system 82. Some of the fuel which directly impacts walls 94 then is drawn into combustion chamber 74, while the remainder is left on the walls 94 as a residue.

A preferred embodiment of the present invention advantageously controls the delivery of fuel to the intake port in a manner which compensates for the difference between fuel condensation and evaporation on engine surfaces (i.e. the change in fuel mass on the walls of the induction system). Compensation is also provided for generating a base fuel value according to any of a variety of known methods, including open-loop and closed-loop control methods, determining a value corresponding to the rate of change of fuel film mass on the walls of the induction system, and altering the base fuel value in accordance with the value corresponding to the rate of change of fuel film mass on the walls of the induction system. The rate of change of fuel film mass on the walls of the induction system is advantageously calculated by measuring the engine coolant temperature which is indicative of the temperature of the walls of the induction system, determining a valve effect value which is indicative of the effect of intake valve temperature on the vaporization of fuel injected into the induction system and generating a transient fuel compensation value as a function of both the engine coolant temperature and the valve effect value. The fuel injector signal 48 is thus comprised of a base fuel value, calculated by known methods under an open or closed loop method of control and a transient fuel compensation value which is added to the base fuel value and is generated in a manner to be described.

Figure 2:
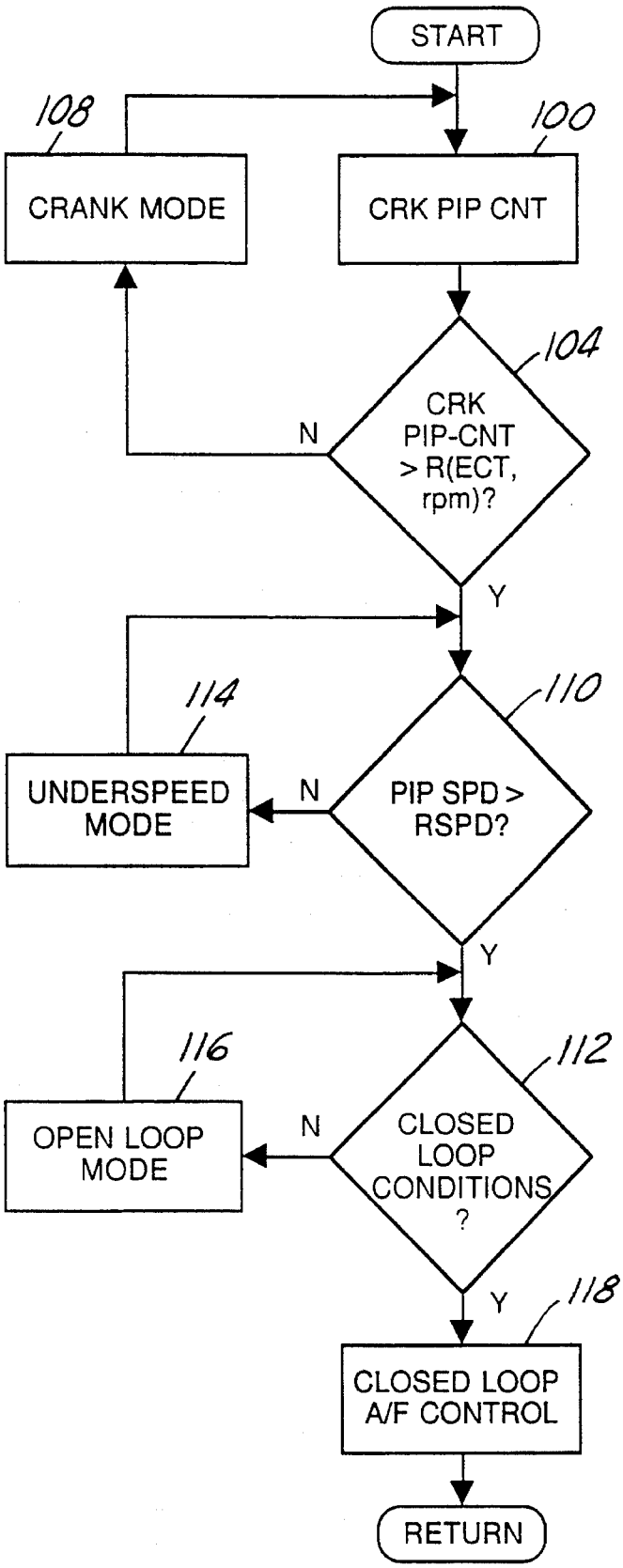
FIGS. 2, 3, and 4A–4C are flow charts showing the operation of a preferred embodiment of the invention.
Figure 3:
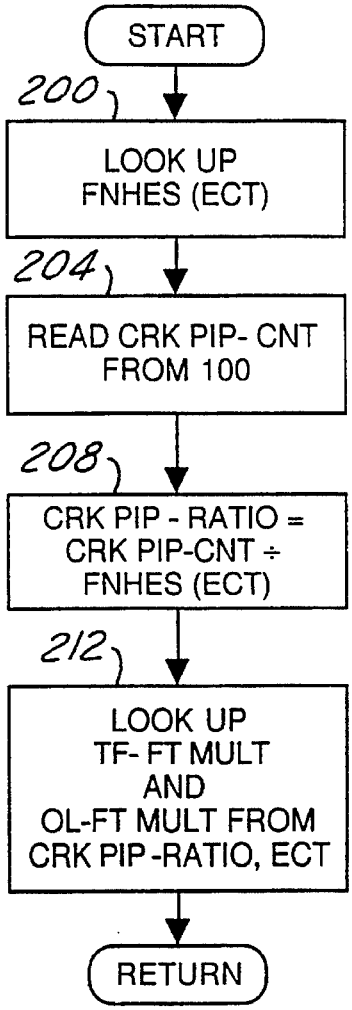

Before describing transient fuel correction in detail, a description of detecting fuel distillation point and generating a fuel type correction signal to correct fuel delivery for fuels having different distillation points is provided with reference to FIGS. 2 and 3.

In this particular example, two fuel type correction signals are generated as follows: Fuel type correction signal or multiplier TF-FTMULT is applied to the transient fuel compensation value; and fuel type correction signal or multiplier OL-FTMULT is applied to the base fuel calculation during open loop fuel control including underspeed fuel operation.

Referring now to FIG. 2, transitions in signal PIP are counted during engine cranking to generate signal CRKPIP at 100. When PIP count CRKPIPCNT is less than reference count R (ECT, rpm), which is determined as a function of engine coolant temperature ECT and speed, engine 8 remains in the crank mode (104, 108). During the crank mode, fuel is delivered to engine 8 as a function of engine coolant temperature ECT.

When PIP count CRKPIP-CNT exceeds reference R at 104, the crank mode is detected as being terminated. The engine under speed models then entered and continues as long as engine speed, determined by signal PIPSPD derived from the PIP signal, is less than reference speed RSPD (110, 114). During the underspeed mode, a base open loop fuel quantity is provided by:
MAF·KAM/AFD·FV(ECT,LOAD,TIME). This base fuel value is corrected by underspeed multiplier USFUEL and further corrected by open loop fuel type correction signal OL-FTMULT. This corrected open loop fuel quantity as shown by the following equation:

$$F=\left[\frac{MAF\times KAM}{AFD\times FV(ECT,\mathrm{LOAD},\mathrm{TIME})}\right]\times USFUEL\cdot OL-FTMULT$$

where MAF is a measurement of inducted air flow; KAM is a correction factor adaptively learned during previous feedback control from feedback variable FV; AFD is a desired air/fuel ratio which, in this particular example, is stoichiometry; FV is a feedback variable which is forced to be independent of HEGO sensor 44 during open loop operation. More specifically feedback variable FV is set as a function of engine coolant temperature ECT, engine load, and time since engine start; USFUEL is an underspeed fuel multiplier which provides fuel enrichment during the engine underspeed mode; and OL-FTMULT is the fuel type correction value for the open loop mode. Signal OL-FTMULT corrects for the detected distillation point of the particular fuel type used as described in greater detail later herein with particular reference to FIG. 3.

Continuing with FIG. 2, the underspeed mode is terminated when engine speed exceeds reference speed RSPD at 110. Open loop fuel control then continues without the underspeed fuel correction signal USFUEL. However, transient fuel compensation TFC-FUEL is now applied to the base open loop fuel quantity. And, transient fuel Compensation TFC-FUEL is corrected for fuel distillation point by transient fuel type multiplier TF-FTMULT. Open loop fuel is thus provided by the following equation:

$$F=\left[\frac{MAF\times KAM}{AFD\times FV(ECT,\mathrm{LOAD},\mathrm{TIME})}\right]\times USFUEL\times OL-FTMULT+TFC-\mathrm{FUEL}\cdot TF-FTMUL$$

Continuing with reference to FIG. 2, open loop fuel control terminates when closed loop fuel control conditions are detected (112, 114). In this particular example, closed loop fuel control is entered (116) when engine coolant temperature ECT exceeds a threshold temperature. During closed loop fuel control, fuel is delivered by the following equation:

$$F=\left[\frac{MAF\times KAM}{AFD\times FV(ECT,\mathrm{LOAD},\mathrm{TIME})}\right]\times USFUEL\cdot+TFC-\mathrm{FUEL}\cdot TF-FTMULT$$

where feedback variable FV is generated in a conventional manner by proportional plus integral control from HEGO sensor 44.

Referring now to FIG. 3, generation of fuel type correction factors TF-FTMULT and OL-FTMULT are now described. Signal FNHES is first looked up as a function of engine coolant temperature ECT at 200. Signal. FNHES is correlated with a reference distillation point of a reference fuel. The ratio (CRKPIP-RATIO) of signal CRKPIP-CNT to signal FNHES is calculated at 208.

The fuel type correction multipliers are then read from a look-up table of ratio CRKPIP-RATIO and engine coolant temperature ECT. As previously described herein with reference to FIG. 2, fuel type multiplier TF-FTMULT is applied to transient fuel compensation TFC-MULT to correct for changes in fuel distillation point when fuels having different volatility are used. Similarly, open loop fuel type correction multiplier OL-FTMULT is applied to the open loop base fuel value to correct for changes in fuel distillation point,when different fuels are used.

Figure 4A:
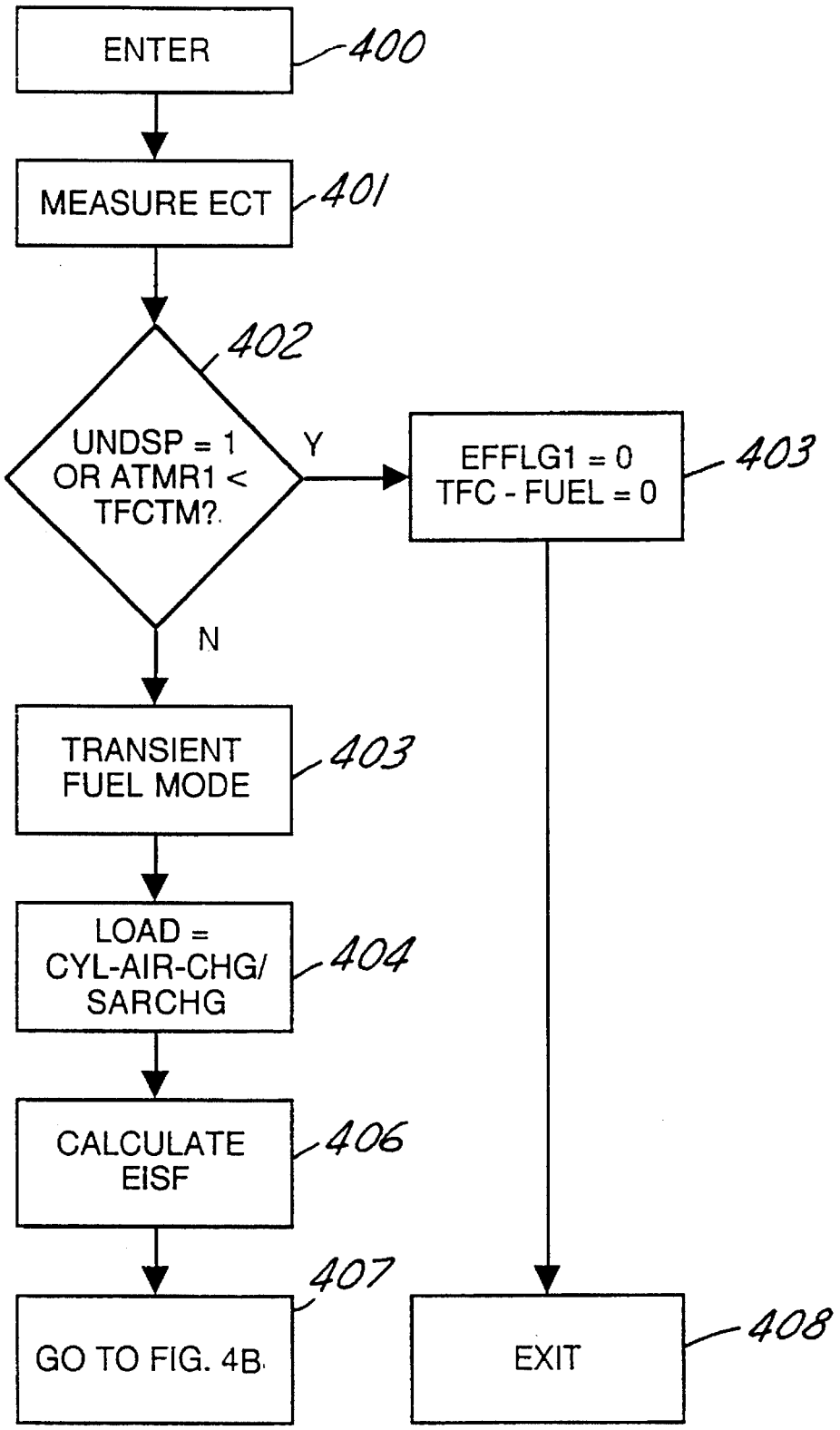
Figure 4B:
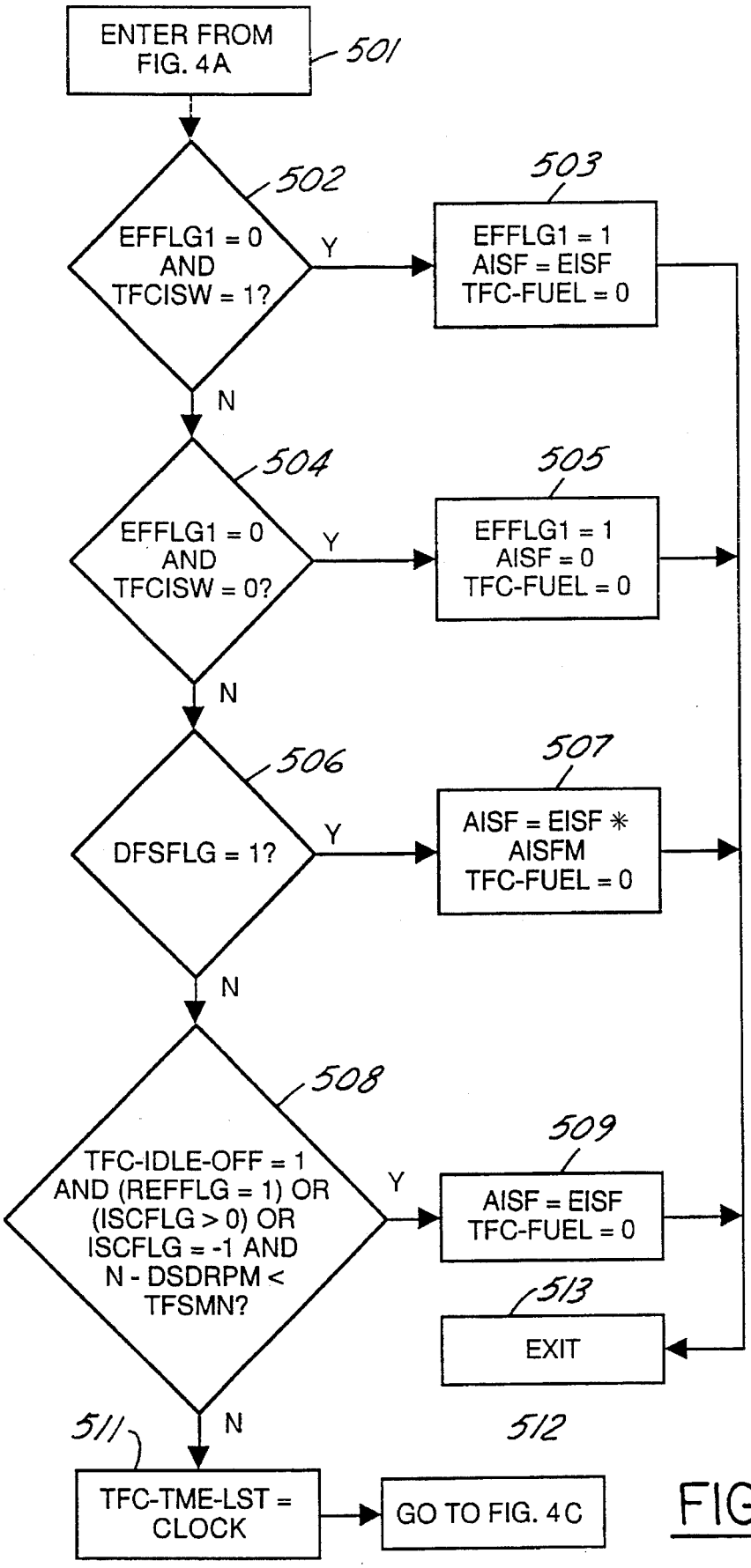
Figure 4C:
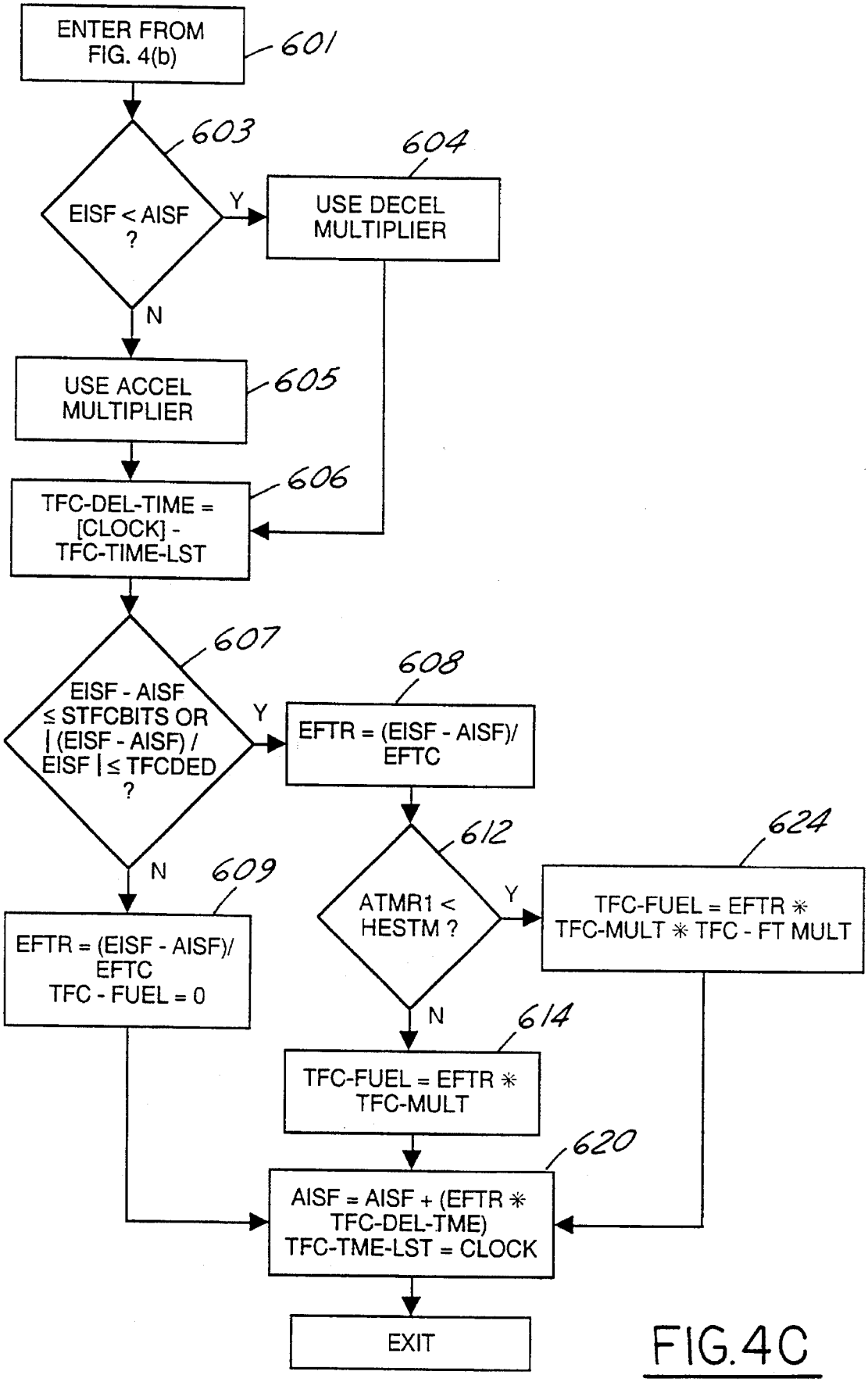

Referring now to FIGS. 4A–4C, generation of transient fuel compensation TFC-MULT is now described. The steps shown in FIGS. 4A–4C comprise a portion of a background loop which is executed continuously by the controller 10. At 401 engine coolant temperature ECT is read and stored. At 402 two threshold comparisons are made to determine if the engine is operating in a proper mode for transient fuel compensation, and if an adequate amount of time from engine crank has elapsed for transient fuel compensation to begin. The first determination is made by testing a flag, UNDSP which is set to the value one by the controller 10 if the engine is in an underspeed or crank mode. If UNDSP=0 then the engine is in neither underspeed or crank mode and transient fuel compensation may be performed, so long as an adequate amount of time has elapsed from exiting crank mode. the preferred embodiment advantageously allows a predetermined period of time, represented by a value TFCTM, to elapse after exiting crank mode in order to allow various aspects of engine operation to adequately stabilize such that accurate measurements of engine operating parameters may be made. This determination is made by comparing a value ATMR1, which corresponds to time elapsed since exiting crank mode, to the value TFCTM and performing transient fuel compensation if ATMR1 is greater than or equal to TFCTM. If transient fuel compensation is not to be performed, then the value EFFLG1 is set to zero. EFFLG1 is an equilibrium fuel flag which controls the setting of an initial value of an actual fuel mass flag which controls the setting of an initial value of an actual fuel mass value AISF, which represents the actual fuel film mass residing on the walls 94 of the induction system 82 when the engine is operating under transient conditions. TFC-FUEL, the transient fuel compensation value, which indicates the fuel mass per injection from transient fuel compensation, is also set to zero and the routine is exited at 408.

If controller 10 at step 402 determines that transient fuel compensation is to be performed, then at 404 a load value, LOAD is calculated by the following relationship:

$$LOAD=CYL\text{-}AIR\text{-}CHG/SARCHG$$

where

SARCHG represents a standard air charge value at standard temperature and pressure obtained by dividing the engine displacement (in cubic inches) by the number of cylinders, and CYL-AIR-CHG is a value indicative of engine load and is calculated by controller 10 as a function of mass air flow into the induction system as measured by air flow meter 54 and engine angular speed as indicated by signal PIP.

At 406 an equilibrium fuel mass value EISF, which is indicative of the fuel mass residing on the walls of the induction system when the engine is operating under substantially steady state operation, is calculated according to the following relationship:

$$EISF=FN1321(ECT,LOAD)*FN313(n)*MTEISF$$

where

FN1321(ECT,LOAD) is a value obtained from a table in which are stored predetermined values indexed by the variables ECT representative of engine coolant temperature, and LOAD representative of engine load;

FN313(N) is a value representative of an equilibrium intake surface fuel multiplier at a particular engine speed, N; and MTEISF is a predetermined multiplicative constant.

As indicated at 407 and 501, FIG. 4B shows the steps performed by the preferred embodiment after step 406 in FIG. 4A. The preferred embodiment advantageously checks certain flags and variables at steps 502, 504, 506 and 508 in order to determine .the operating mode of the engine and hence the amount of transient fuel control required. Steps 502, 504, 506 and 508 each contain certain flags and variables, the value of which determine an initial value for the actual fuel mass value AISF.

Upon an initial pass of the transient fuel compensation routine, EFFLG1 will be equal to zero, and TFCISW will be set to one or zero based upon an empirical determination of an amount of fuel required to establish a film mass on the walls of the induction system just after engine crank. Upon the first pass, if at block 502 TFCISW=1, then at 503 the actual fuel mass value AISF is set equal to the equilibrium fuel mass value EISF and the transient fuel compensation value TFC-FUEL is set to zero, meaning that the fuel injector signal is not altered by the transient fuel condensation value TFC-FUEL.

At 504 upon the initial pass, EFFLG1 will equal zero, as stated above. If TFCISW also equals zero, then at 505 AISF is set to zero, EFFLG1 is set to one and TFC-FUEL is set to zero, as in step 503. The routine is then exited at 513. If at step 502 upon the initial pass TFCISW does not equal one then the routine proceeds to step 504.

At 506, a deceleration fuel shutoff flag DFSFLG is checked. If DFSFLG=1, indicating that the engine is in a deceleration fuel shutoff condition, then at 507 the actual fuel mass value AISF is calculated by multiplying the equilibrium fuel mass value EISF times a predetermined multiplier AISFM which is indicative of the fuel mass on the walls of the induction system during the deceleration fuel shutoff condition. The value TFC-FUEL is set to zero and the routine is exited at 513.

If DFSFLG is not equal to one, then at 508 a series of conditions are checked to further determine the mode in which the engine is operating. TFC-IDLE-OFF is a calibration switch which disables the use of transient fuel control during engine idle. REFFLG is a flag which, when having a value of one, indicates that the engine is in an idle fuel modulation mode. ISCFLG is an idle speed control flag which indicates whether the engine is in an idle speed control mode. Idle speed control mode is an engine operating mode which actively controls engine idle speed. ISC-FLG will contain a value of one or two when the engine is in one of two closed-loop rpm control modes, a value of zero or minus one when the engine is in one of two dashpot control modes. The variable N indicates engine angular speed in revolutions per minute (RPM), DSDRPM is a variable representing a desired RPM value at engine idle and TFSMN is a constant representing an RPM value above idle, below which transient fuel control is disabled. If the conditions checked at 508 result in step 509 being executed, then the actual fuel mass value AISF is set equal to the equilibrium fuel mass value EISF, meaning that the engine is essentially operating under steady state conditions, TFC-FUEL is set to zero, thus disabling transient fuel compensation, and the routine is exited at 513. If the condition checked at 508 results in step 511 then the variable TFC-TME-LST is set equal to a value indicated by a real time clock represented by a variable CLOCK as seen at 511.

As indicated at 512 and 601, FIG. 4C shows the steps performed by the preferred embodiment after step 511 in FIG. 4B. At 603, the equilibrium fuel mass value EISF is compared to the actual fuel mass value AISF to determine if the engine is under an acceleration or deceleration condition. The preferred embodiment of the present invention advantageously contains two tables which are indexed by a value indicative of the time elapsed since engine crank and by a value indicative of engine coolant temperature. The tables contain a plurality of valve effect values which are empirically derived and are representative of the effect of intake valve temperature on the vaporization of fuel in the induction system of the engine. One table contains valve effect values which are used if the engine is detected to be in an acceleration condition and the other table contains valve effect values which are used if the engine is detected to be in a deceleration condition. By storing different valve effect values for acceleration and deceleration conditions, the preferred embodiment allows different transient compensation values to be generated. Consequently, when the engine is under an acceleration condition, the transient fuel compensation value TFC-FUEL is generated in a manner which provides for enhanced power, and when the engine is under a deceleration condition, the transient fuel compensation value is generated in a manner which provides for enhanced air/fuel control and consequently reduced emissions.

If the engine is under an acceleration condition then at 605: (a) several acceleration multipliers will be used to calculate an equilibrium fuel time constant EFTC which is representative of a rate of change of the fuel mass on the walls of the induction system while the engine is under acceleration, and (b) a value TFC-MULT is calculated, which is a transient fuel multiplier value indicative of the effect of intake valve temperature on the vaporization rate when the engine is under acceleration, according to the following relationships:

$$EFTC=FN1322A(ECT,LOAD)*MTEFTC$$

$$TFC\text{–}MULT=FN1323A(ECT,ATMR1)*STCF*DT12S$$

where:

FN1322A(ECT,LOAD) is a unitless value obtained from a table, indexed by engine coolant temperature ECT and engine load LOAD, and stored in a table which contains predetermined values representative of a transient fuel time constant for an engine under acceleration;

MTEFTC is a predetermined equilibrium fuel time constant multiplier;

FN1323A(ECT,ATMR1) is a unitless valve effect value obtained from a table, indexed by engine coolant temperature and time since engine crank, and stored in a table which contains a plurality of values representative of the effect of the changing intake valve temperature during engine warm-up on the vaporization of fuel in the induction system when the engine is under acceleration;

STCF is a conversion factor for converting time measured in seconds to time units; and DT12S is a variable representative of the time elapsed between adjacent rising edges of the PIP signal.

If at 603, the engine is determined to be under a deceleration condition then at 604, several deceleration multipliers will be used to calculate values for the variables EFTC and TFC-MULT according to the following relationships:

$$EFTC=FN1322D(ECT,LOAD)*MTEFTC$$

$$TFC\text{–}MULT=FN1323D(ECT,ATMR1)*STCF*DT12S$$

where:

EFTC is an equilibrium fuel time constant representative of a rate of change of the fuel mass on the walls of the induction system while the engine is under deceleration;

FN1322D(ECT,LOAD) is a value obtained from a table, indexed by engine coolant temperature ECT and engine load LOAD, and stored in a table which contains predetermined values representative of a transient fuel time constant for an engine under deceleration;

MTEFTC is as explained above;

TFC-MULT is a transient fuel multiplier value indicative of the effect of intake valve temperature on the vaporization rate when the engine is under deceleration;

FN1323D(ECT,ATMR1) is a valve effect value obtained from a table, indexed by engine coolant temperature and time since engine crank, and stored in a table which contains a plurality of values representative of the effect of the changing intake valve temperature during engine warm-up on the vaporization of fuel in the induction system when the engine is under deceleration; and STCF and DT12S are as explained above.

At 606, an elapsed time value TFC-DEL-TME is calculated by subtracting the value indicative of the last time the value AISF was updated, TFC-TME-LST, from a real time value clock, is generated by a real time clock contained in controller 10. At 607 two comparisons are made to determine whether the difference between the equilibrium fuel mass value EISF and the actual fuel mass value AISF is sufficient to require transient fuel compensation. The preferred embodiment of the present invention advantageously utilizes a deadband value, represented in FIG. 4C at 607 by the values TFCBITS and TFCDED, which represent respectively, a fixed value and a percentage value, against which the value EISF minus AISF is compared. TFCBITS prevents transient fuel compensation if the difference between the equilibrium fuel mass and actual fuel mass sufficiently small as to be attributable to inadequate resolution in the controller 10 in the calculation of the EISF or AISF. In the case of TFCDED, which represents a percentage difference between the equilibrium or steady state fuel value and the transient fuel value, the percentage difference between EISF and AISF is determined and compared.

If the difference between the equilibrium fuel mass value and the actual fuel mass value is of a sufficient value, then an equilibrium transfer rate value EFTR, representative of an equilibrium transfer rate of fuel from the walls of the induction system to the combustion chamber, is calculated according to the following relationship:

$$EFTR=(EISF\text{–}AISF)/EFTC$$

where

EFTC, EISF and AISF are as explained above.

If the conditions checked at 607 result in step 608 and the time in running mode is greater than reference HESTM which is a function of temperature (612), then transient fuel compensation is calculated as shown in step 614. More specifically, transient fuel compensation TFC-FUEL, which represents the fuel mass per injection from transient fuel compensation in lbs/cylinder, is calculated by multiplying EFTR times TFC-MULT at 614. If either of the comparisons performed at 607 are true, then at 609 EFTR is calculated as above and TFC-FUEL is set to zero.

At 620 the value AISF is calculated for use in steps 607 and 608 upon subsequent execution of the transient fuel control routine, and the routine is exited at 611. AISF is incrementally altered at 610 by adding EFTR multiplied by TFC-DEL-TME. The value TFC-TME-LST is then set equal to the current time value CLOCK contained in the real-time clock. As discussed above, the value TFC-FUEL is used by the controller 10 in calculating the value for the fuel injector signal transmitted via signal line 48. Specifically, TFC-FUEL is added to a base fuel value which is generated by the controller 10 by one of a variety of known methods of fuel control.

When time in the running mode is greater than reference HESTM, transient fuel compensation is calculated at 624 by multiplying EFTR times TFC-MULT and then multiplying this product times transient fuel type multiplier TFC-FT-MULT. Generation of transient fuel type multiplier TFC-FTMULT and its advantageous effects were described previously herein with particular reference to FIG. 3.

This concludes a description of the preferred embodiment. The reading of it by those skilled in the art will bring to mind many alterations and modifications without departing from the spirit of the invention. For example, the fuel type multipliers may be generated by means other than forming a ratio between engine rotations until start and a reference fuel value. Accordingly, it is intended that the scope of the invention be defined only by the following claims.

I claim:

1. A method to correct for variations in distillation point of fuel inducted into an engine, comprising the steps of:

delivering fuel to the engine in relation to a fuel delivery signal;

counting engine rotations during engine cranking until engine start;

generating a fuel type correction signal related to the fuel distillation point from said count; and correcting said fuel delivery signal with said fuel type correction signal.

2. The method recited in claim 1 wherein said step of generating said fuel type correction signal is further responsive to a measurement of engine temperature.

3. The method recited in claim 1 wherein said step of generating said fuel type correction signal further comprises a step of generating a ratio of said count to an estimated count of engine rotations occurring during engine cranking until engine start when using a reference fuel having a reference distillation point.

4. The method recited in claim 3 wherein said step of generating said fuel type correction signal further comprises a step of looking up said fuel type correction signal from a table of said ratios and engine temperature.

5. The method recited in claim 1 wherein said fuel delivery signal is responsive to an indication of air mass inducted into the engine and a desired air/fuel ratio.

6. The method recited in claim 5 further comprising a step of adding a transient fuel correction signal to said fuel delivery signal to compensate for fuel condensing on engine surfaces.

7. The method recited in claim 6 wherein said transient fuel correction signal is added after an indication is provided that engine speed is greater than a predetermined speed.

8. The method recited in claim 7 wherein said engine start is indicated when said indication of engine speed is greater than a preselected speed.

9. The method recited in claim 6 further comprising a step of correcting said transient fuel correction signal with a second fuel type correction signal, said second fuel type correction signal being generated from said count.

10. The method recited in claim 5 further comprising a step of correcting said fuel deliver signal with a feedback variable derived from an exhaust gas oxygen sensor positioned in the engine exhaust during closed loop engine control.

11. A method to correct for variations in distillation point of fuel inducted into an engine, comprising the steps of:

counting engine rotations during engine cranking until engine speed exceeds a threshold speed related to engine start;

generating a fuel type correction related to fuel distillation point from said count of engine rotations and a reference fuel type value and engine temperature;

providing a fuel delivery signal from an indication of air mass inducted into the engine and a desired air/fuel ratio;

adding a transient fuel correction related to a difference between fuel condensation and evaporation and engine surfaces to said fuel delivery signal; and correcting said transient fuel correction with said fuel type correction.

12. The method recited in claim 11 further comprising a step of correcting said fuel deliver signal with said fuel type correction.

13. The method recited in claim 11 further comprising a step of adding said transient fuel correction to said fuel delivery signal after the engine exceeds a preselected engine speed greater than said threshold speed.

14. A system to correct for variations in distillation point of fuel inducted into a multicylinder engine, comprising:

an intake manifold coupled to the engine having at least one intake valve for each cylinder coupled to said intake manifold;

at least one fuel injector coupled to said intake manifold for injecting fuel into said intake valve;

transient fuel correction means for providing a transient fuel correction to a fuel delivery signal driving said fuel injector, said transient fuel correction being related to a difference between fuel condensing and fuel evaporating from said intake manifold and said intake valve; and fuel type correction means for correcting said transient fuel correction with a fuel type correction related to fuel distillation point, said fuel type correction being generated from a count of engine rotations occurring during engine cranking until engine starts.

15. The system recited in claim 14 wherein said fuel type correction is generated from a ratio of said count to a reference count generated from a reference fuel.

16. The system recited in claim 14 further comprising means for correcting said fuel delivery signal with said fuel type correction.

* * * * *